United States Patent [19]

Welch

[11] 4,002,033

[45] Jan. 11, 1977

[54] ROTARY DISPLACER FOR ROTARY ENGINES OR COMPRESSORS

[75] Inventor: Robert Maurice Welch, Denville, N.J.

[73] Assignee: Bell Telephone Laboratories, Incorporated, Murray Hill, N.J.

[22] Filed: Feb. 4, 1975

[21] Appl. No.: 546,935

[52] U.S. Cl. ..... 60/682; 418/191

[51] Int. Cl.[2] ..... F01K 25/02

[58] Field of Search ..... 60/650, 682; 418/191

[56] References Cited

UNITED STATES PATENTS

| | | | |
|---|---|---|---|
| 165,805 | 7/1875 | Disston | 418/183 |
| 685,775 | 11/1901 | Lindsay | 418/108 |
| 730,679 | 6/1903 | Monroe | 418/191 |
| 1,098,256 | 5/1914 | Harper | 418/122 |
| 2,275,205 | 3/1942 | Straub | 123/8.15 |
| 2,786,332 | 3/1957 | Taverniers | 60/39.61 |
| 2,856,120 | 10/1958 | Fawzi | 418/141 |
| 2,863,425 | 12/1958 | Breelle | 123/8.15 |
| 2,870,752 | 1/1959 | Breelle | 123/8.05 |
| 3,040,530 | 6/1962 | Yalnizan | 60/39.61 |
| 3,066,851 | 12/1962 | Marshall | 418/78 |
| 3,297,006 | 1/1967 | Marshall | 123/8.09 |
| 3,467,070 | 9/1969 | Green | 123/8.33 |
| 3,699,681 | 10/1972 | Frutschi | 60/682 |
| 3,843,284 | 10/1974 | Spinnett | 418/191 |

OTHER PUBLICATIONS

Popular Science, July 1969, p. 45.

Rotary Piston Machines, Felix Wanke, London, Liffe Books Ltd.

*Primary Examiner*—Martin P. Schwadron
*Assistant Examiner*—H. Burks, Sr.
*Attorney, Agent, or Firm*—Frederick W. Padden

[57] ABSTRACT

A rotary displacer mechanism of the rotary-abutment type utilizes improved piston and sealing rotor design to reduce internal leakage and increase volumetric efficiency. A rotary-abutment positive displacement mechanism typically comprises a housing which encloses a rotary piston having a plurality of lobes and a cylindrical sealing rotor having a plurality of cavities for accepting the piston lobes during rotation. The improved piston design consists of a cylindrical stationary block around which only the lobes of the piston are rotatable. This design reduces bearing loads and allows for improved sealing characteristics. In addition, the sealing rotor is constructed with two axial sections of unequal diameter to provide a valving operation on either the intake or the discharge ports of the displacer, as required, and, at the same time, maintain communication between working volumes in the main rotor and sealing rotor bores. The design, by allowing the sealing rotor to perform the valving function, minimizes dead volume in the mechanism thereby increasing volumetric efficiency.

15 Claims, 8 Drawing Figures

ROTARY DISPLACER FOR ROTARY ENGINES OR COMPRESSORS

BACKGROUND OF THE INVENTION

This invention relates to rotary piston machines, and, in particular, to rotary piston machines of the rotary-abutment type.

Rotary-abutment machines typically consist of a housing which contains two parallel cylindrical bores. A cylindrical piston is located in one bore and a cylindrical rotary abutment or sealing rotor is located in the other bore. The piston is provided with a plurality of lobes to provide surfaces for partitioning the housing bores into working volumes. The sealing rotor has a plurality of cavities cut in its circumference and is synchronized in rotation with the piston so that the lobes enter the cavities during operation. The piston and sealing rotor are physically arranged to maintain close clearance therebetween so that working fluid, trapped between the piston lobes, housing, and sealing rotor, is compressed or expanded according to the direction of rotation of the piston. To avoid friction which causes a reduction in efficiency and may require lubrication of parts in rubbing contact, many prior art designs have used noncontacting seals between the various components of the engine. A frictionless seal is usually constructed by aligning the moving parts with a small clearance between each of the moving members. One, or both, of the members is provided with a series of slots or grooves. Such a seal, which is usually known as a "labyringh" seal, is effective because the working fluid, on passing through the sealing area, expands into each of the slots causing turbulence and the fluid must then regroup to pass through the next restriction. The result of the turbulence and regrouping is an effectively high resistance to leakage.

The efficiency of labyrinth seals is directly related to the distance the working fluid must traverse and the number of slots which are provided. Therefore, when labyrinth seals are utilized on a rotary-abutment machine, a serious seal problem develops at the seal between the piston and the sealing rotor. Since the piston and sealing rotor are in virtual contact tangentially and are both rotating, a very small area is involved over which the sealing can take place. Thus, labyrinth seals, which may be effective to seal the piston relative to the housing, are not effective to seal piston relative to the sealing rotor. Leakage at the seal between the piston and sealing rotor places an effective limit on the minimum speed at which the engine operates efficiently and reduces efficiency at low compression ratios.

Aother contributor to poor efficiency is excessive dead volume in the displacement mechanism. Excessive dead volume reduces the volumetric efficiency of the engine and typically arises when the valving operations (which are necessary to perform expansion or compression of the working fluid) are carried on outside of the housing cavities. Several prior art designs have attempted to utilize the sealing rotor as a valve cn either the intake or the discharge port. These designs, however, have been unable to perform simultaneously three functions that are necessary in certain heat engine applications of rotary displacers:

1. One port must always be open. That is, the working volumes performing constant pressure processes must always be in communication with a heat exchanger volume connected to this port.

2. One port must be periodically closed off or "valved". That is, the working volumes in which compression or expansion of the working fluid takes place must be in communication with the connected heat exchanger volumes during the intake and exhaust processes and isolated from the heat exchanger volumes during the compression and expansion processes.

3. The working volumes in the main rotor and sealing rotor bores must always be in communication with each other during variable pressure (compression or expansion) processes.

In order that all three of the above requirements be satisfied, prior art designs have required that the valving function be performed by a separate valve mechanism rather than by the sealing rotor. Such designs entail a penalty in terms of the unswept volume (dead volume) in the passageway to or from this separate valving mechanism.

Therefore, there appears to be a need for a rotary piston machine with a small dead volume and improved volumetric efficiency and low internal leakage.

Accordingly, it is an object of the present invention to increase volumetric efficiency in a rotary piston machine.

It is another object of the present invention to reduce seal leakage between the piston and sealing rotor of a rotary-abutment machine.

It is a further object of the present invention to reduce the dead volume in a rotary piston machine.

SUMMARY OF THE INVENTION

The foregoing and other objects are achieved in accordance with the principles of the present invention in one illustrative embodiment thereof which utilizes an improved piston and sealing rotor design. The improved piston comprises two parts: a stationary cylindrical block and a plurality of bar-shaped pistons which rotate around the block. Since the central portion of the piston or block is stationary, the leakage path between the sealing rotor and the block can be appreciably longer than was possible in the prior art designs.

In particular, a part-cylindrical recess is cut into the periphery of the stationary block to receive the sealing rotor. The engagement length may be varied by changing the distance between the axis of the sealing rotor and the axis of the stationary piston block. Noncontacting labyringth seals may be effectively used in this point because of the relatively long length of the leakage path.

The improved sealing rotor design involves the use of a stepped sealing rotor with two axially aligned sections, one of which has a smaller diameter than the other. The intake and discharge ports of the displacer mechanism are arranged so that one port is positioned over the larger diameter section of the sealing rotor and the other port is positioned over the smaller diameter section. Thus, as the sealing rotor rotates, the port located over the larger section is periodically opened and closed. The other port, however, remains open throughout the operating cycle due to the smaller diameter of the sealing rotor.

DETAILED DESCRIPTION

Figure 1:
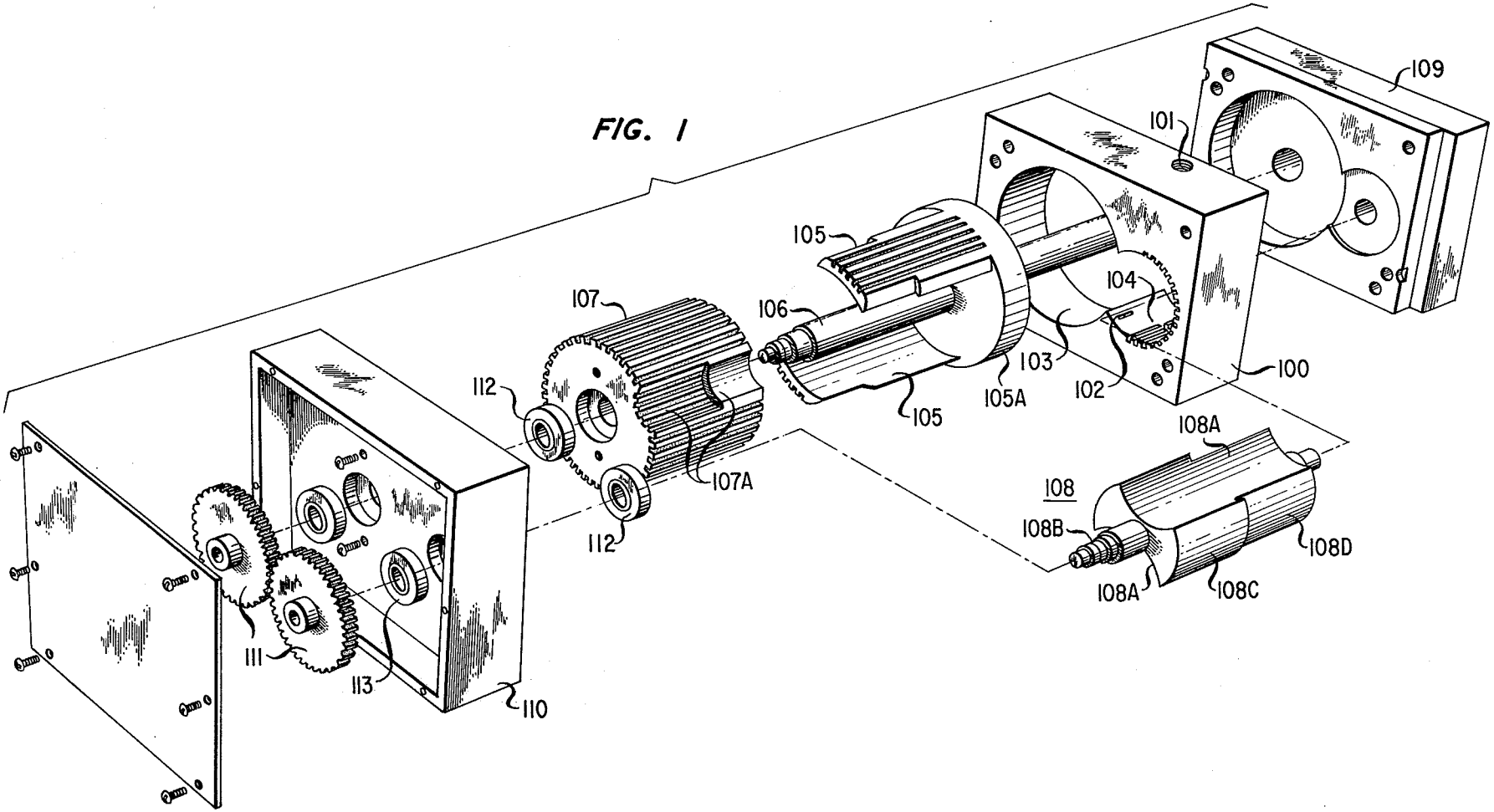
FIG. 1 is an exploded view of a specific rotary piston displacer mechanism utilizing the principles of the present invention.

FIG. 1 shows a specific embodiment of a rotary displacer mechanism in an exploded diagram. The basic components of the mechanism consist of a housing 100 which contains two cylindrical bores, 103 and 104. Discharge and intake ports 101 and 102 are located in the housing so that they communicate with bore 104. Located in bore 103 is the main piston and shaft assembly consisting of pistons or lobes 105 and shaft 106. Pistons or lobes 105 are connected to shaft 106 by means of a circular plate 105A. For illustration, two pistons are shown, although it is clear that one or more pistons will suffice. Pistons 105 revolve around a cylindrical block 107. The assembly comprised of pistons 105 and cylindrical block 107 may also be referred to collectively as the main piston or male rotor assembly by those skilled in the art. The male rotor assembly meshes with sealing rotor 108 which may also be referred to as the female rotor assembly. In addition, sealing rotor assemblies which are used in rotary displacers are commonly designated as rotary abutments. Sealing rotor or rotary abutment 108 has recesses or cavities 108*a* which receive pistons or lobes 105. Cylindrical block 107 has a recess 107A to receive sealing rotor 108 which is located in bore 104. Block 107 is bolted to end cap 110 which forms part of the enclosure housing pistons 105 and sealing rotor 108. The assembly is completed by end cap 109 which is fastened to housing 100. In addition, the end caps, for example, end cap 110, contain seals 112 which prevent escape of working fluid around shaft 106 and sealing rotor shaft 108B. End cap 110 also contains bearings 113 which support shafts 106 and 108B. End cap 109 contains similar seals and bearings which are omitted to simplify the drawing. Pistons 105 and sealing rotor 108 are rotationally synchronized in a 1:1 ratio by gears 111. During rotation, pistons 105 are accepted by recesses 108A in sealing rotor 108. Bores 103 and 104 in housing 100 are arranged so that sealing rotor 108 maintains close clearance with recess 107A in cylindrical block 107 to prevent passage of working fluid around sealing rotor 108. In addition, block 107, pistons 105, and the walls of cylinder bore 104 are provided with labyrinth sealing grooves to provide effective noncontacting seals at these locations.

Figure 1A:
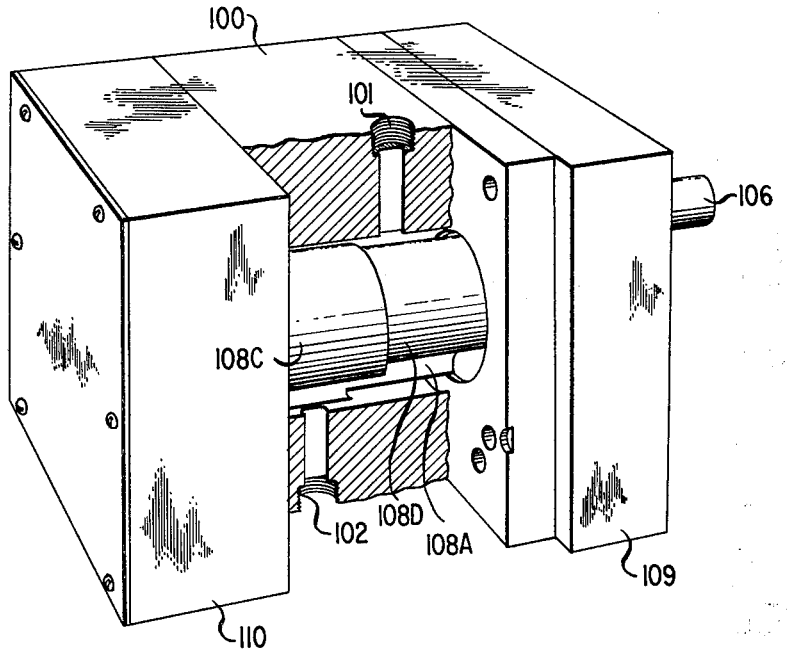
FIG. 1A is an end view cross section of the same embodiment as shown in FIG. 1.

Sealing rotor 108 advantageously hs two sections 108C and 108D. The diameter of section 108D is smaller than the diameter of section 108C which allows sealing rotor 108 to periodically valve port 102 during rotation while port 101 remains in constant communication with the working volume. The location of ports 101 and 102 is shown in more detail in FIG. 1A, in which the assembled displacer is shown with a portion of housing 100 cut away to reveal sealing rotor 108. Ports 101 and 102 are spaced along the axis of sealing rotor 108 so that port 102 is located over larger diameter section 108C of sealing rotor 108, while port 101 is located over the small diameter section 108D of sealing rotor 108. Thus, as sealing rotor 108 rotates during the operation of the displacer mechanism, port 102 is periodically opened and closed. Thus, the working volume enclosed between housing 100, pistons 105, and cylindrical block 107 is in communication with port 102 only when some part of the sealing rotor recess 108A is lined up with port 102. Port 101, however, remains in constant communication with the working volume due to the clearance provided by the smaller diameter of sealing rotor section 108D.

The phasing of opening and closing of port 102 depends on the location of port 102 in sealing rotor cavity 104 and on the "width" of the port perpendicular to the rotor axes. The specific embodiment illustrated lends itself most practically to low pressure ratio operation. Port "width" would be small for high pressure ratios and correspondingly small port areas would result.

Figure 2B:
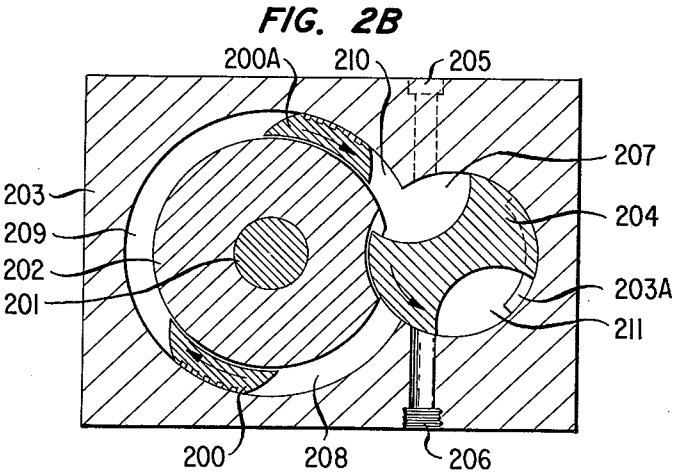
FIGS. 2A–2D are schematic diagrams in cross section of the displacement mechanism in various stages of rotation.
Figure 2D:
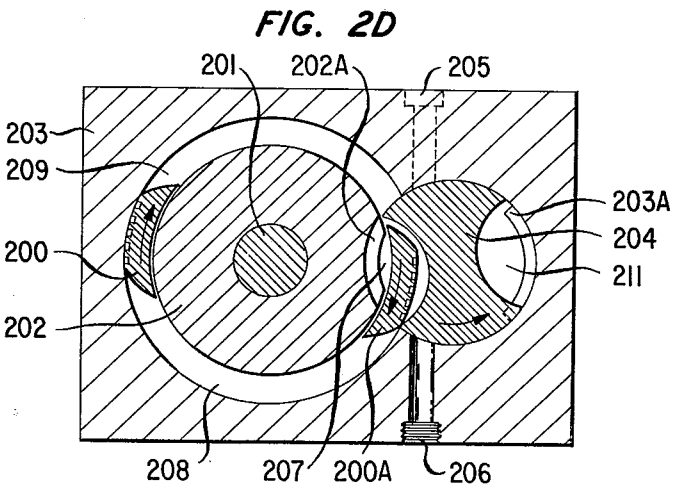
Figure 2A:
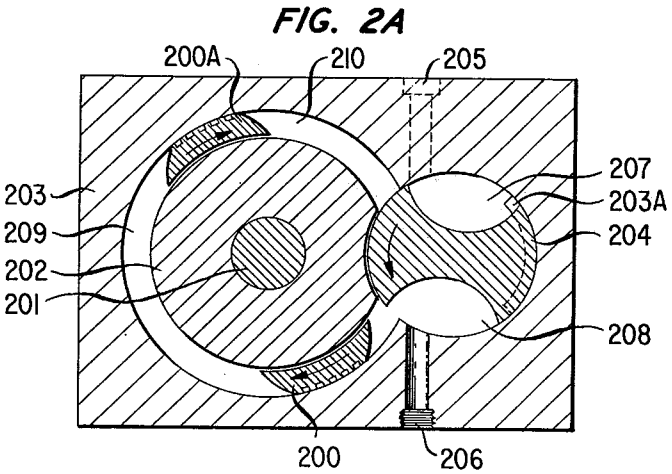

FIGS. 2A–2D show a cross-sectional diagram of the displacer mechanism in various phases of rotation. The displacer mechanism is shown illustratively as an expander mechanism utilized to expand a high pressure working fluid to a lower pressure, generating an output torque. In FIG. 2A, high pressure working fluid enters volume 208 through intake port 206. Close clearance between block 202 and sealing rotor 204 prevents the escape of the working fluid through the space therebetween. In addition, sealing rotor 204 maintains close clearance with the walls of housing 203, thus the working fluid is contained in volume 208. The high pressure working fluid exerts a force on piston 200 causing piston 200 to rotate in a clockwise direction. Advantageously, as previously described, block 202 is fastened to an end cap (not shown) which is in turn fastened to housing 203. Thus, forces produced by the high pressure working fluid pushing on block 202 are transmitted to housing 203 rather than the bearings of shaft 201. The gas loading on the bearings of shaft 201 due to differential working fluid pressure is thus greatly reduced. Forces exerted on piston 200 are primarily in a direction tangential to shaft 201 and are transmitted to shaft 201 by means of a circular plate (not shown) resulting in a useful torque. Sealing rotor 204, which is geared to pistons 200 and 200A, rotates in a counterclockwise direction.

In FIG. 2A, discharge port 205 is in constant communication with volumes 210 and 207 due to its being located over the smaller diameter section of sealing rotor 204. Working fluid trapped in volumes 210 and 207 is forced through discharge port 205 as piston 200A advances during rotation. Since port 205 is always in communication with volumes 210 and 207, piston 200A is resisted in its advance only by a constant discharge pressure. Discharge port 205 is isolated from intake port 206 by an extension 203A of housing 203 which fits with close clearance to the small diameter section of sealing rotor 204. A similar extension (shown in FIG. 2C as extension 202A) of block 202 seals the small diameter section of sealing rotor 204 on the opposite side. Working fluid trapped between pistons 200 and 200A in volume 209 is carried around to the opposite side of the mechanism without expanding or contracting.

In FIG. 2B, sealing rotor 204 has rotated far enough to close intake port 206, thus cutting off the supply of high pressure working fluid. The quantity of working fluid trapped in volumes 208 and 211 continues to be expanded to a lower pressure as rotation proceeds.

Volume 211 communicates with volume 208 via the smaller diameter section of sealing rotor 204 and thus working fluid contained in volumes 208 and 211 continues to exert a force on piston 200 causing the assembly to continue rotation.

Figure 2C:
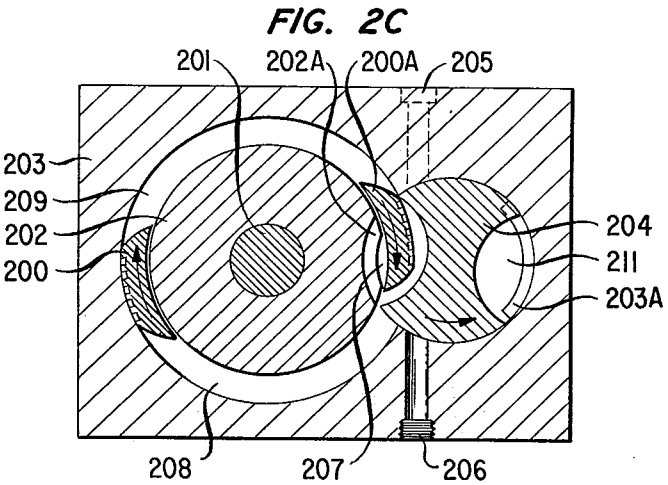

As previously described, sealing rotor 204 and pistons 200 and 200A are synchronized so pistons 200 and 200A engage the recesses in sealing rotor 204 during rotation. As shown in FIG. 2C, as pistons 200 and 200A continue to rotate, piston 200A enters a recess in sealing rotor 204. Working fluid in volumes 208 and 211 is still expanding at this point. Working fluid in volume 207 has been almost completely discharged through port 205. As rotation continues, working fluid in volumes 209 and 211 will be discharged through port 205.

In FIG. 2D, pistons 200 and 200A have rotated through nearly a full cycle. Working fluid which was trapped in volume 209 and carried between pistons 200 and 200A and working fluid in volume 211 now begins to leave the mechanism through discharge port 205. Working fluid in volume 208 is expanded completely and is now trapped between pistons 200 and 200A to be carried around to discharge port 205.

My illustrative displacer mechanism may be used as either an expander mechanism, as shown in FIGS. 2A–2D, or a compressor mechanism by simply reversing the direction of rotation of the main piston or by locating port 205 over the large diameter part of sealing rotor 204 and port 206 over the small diameter. For example, referring to FIG. 2C, when the mechanism is used as a compressor, pistons 200 and 200A will be rotating in a counterclockwise direction. Therefore, working fluid will be compressed in volume 208 ahead of piston 200, while working fluid expands into volume 209 from port 205 which as previously described is in constant communication with volume 209.

Figure 3:
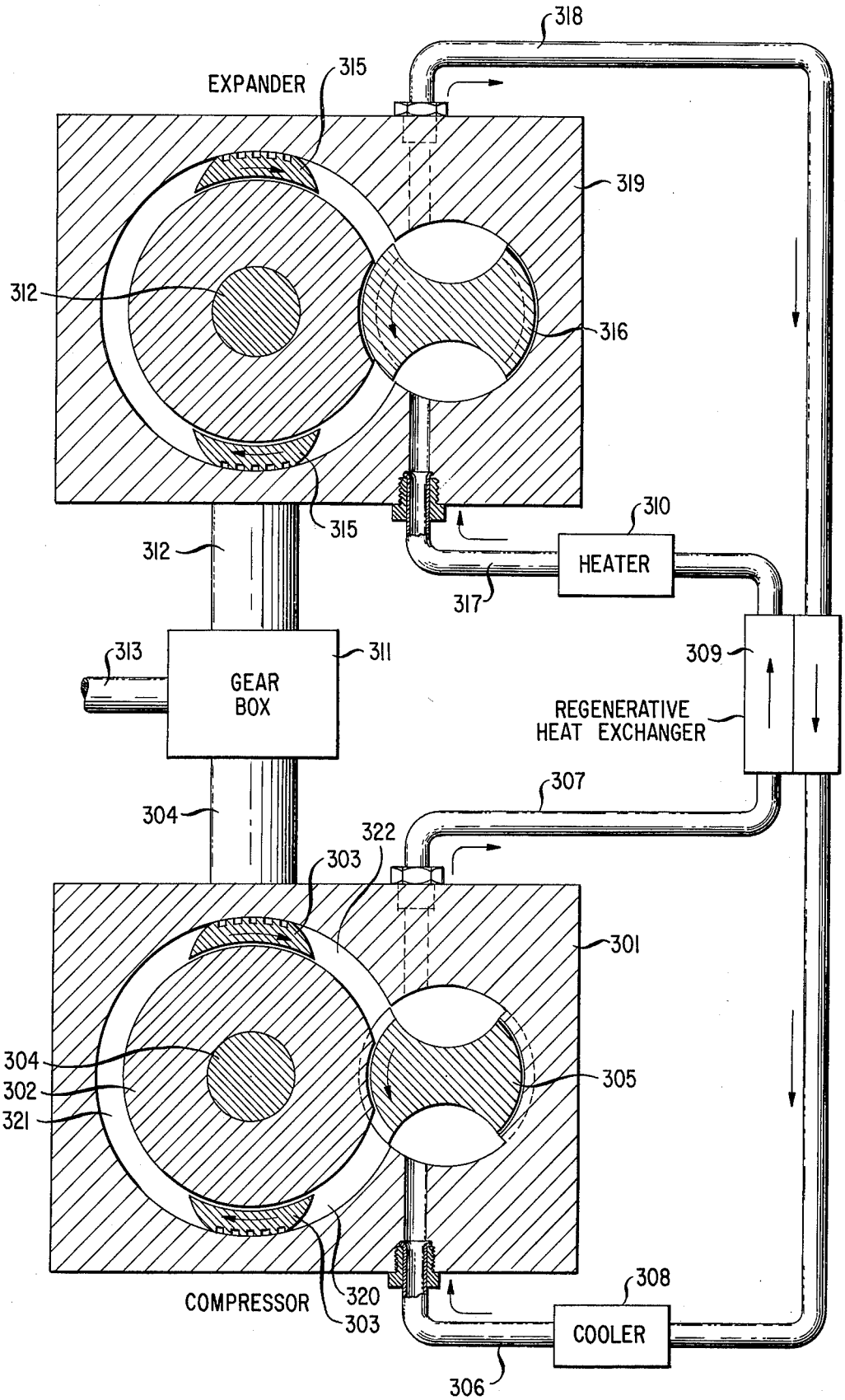
FIG. 3 is a schematic diagram of two displacer mechanisms in an illustrative embodiment of an external combustion engine.

Since the displacer mechanism can be used as compressor or expander, two such mechanisms may be used in conjunction with a heater and cooler to comprise an external combustion engine. One embodiment of such an engine is shown in FIG. 3. Two displacer mechanisms are utilized. Expansion device 319 has a larger swept volume than compression device 301. FIG. 3 is a schematic diagram in which expander 319 and the compressor 301 are shown in cross section; in particular, expander 319 and compressor 301 have been turned at right angles to shafts 312 and 304 in order to more clearly describe the operation of the mechanism. In actual operation, of course, shafts 312 and pistons 315 would be parallel and shaft 304 and pistons 303 would also be parallel. Shafts 304 and 312 are geared together by means of gear box 311. Output shaft 313 is also geared to shafts 304 and 312 by gear box 311. Shafts 304 and 312 could be directly connected where the expander 319 and the compressor 301 are designed to rotate at the same speed.

In operation, high temperature-high pressure working fluid enters expander 319 through intake port 317 and produces a force on piston 315, causing it to rotate in a clockwise direction. Shaft 312, as explained previously, is connected to pistons 315 by a circular plate (not shown). Thus, power is transmitted from shaft 312 to shafts 313 and 304. After the high temperature working fluid has expanded in expander 319 as previously described in connection with FIGS. 2A–2D, it is discharged as a high temperature-low pressure fluid into discharge port 318. The working fluid then passes through regenerative heat exchanger 309 in which it gives up some of its heat to fluid entering heater 310. Working fluid then leaves heat exchanger 309 and passes into cooler 308 where excess heat is removed. Low temperature-low pressure working fluid enters compressor 301 through intake port 306 from cooler 308. Intake port 306 communicates with the smaller diameter section of sealing rotor 305, and thus is in constant communication with volume 320. As the assembly rotates, working fluid becomes trapped between pistons 303 and is carried around in volume 321. As the mechanism rotates further, working fluid is compressed in volume 322 and is discharged as a high pressure-low temperature fluid into discharge port 307.

The high presssure-low temperature working fluid released into port 307 of compressor 301 enters heat exchanger 309 where it is warmed by working fluid exiting from the expander discharge port 318. Further heat is added to the working fluid in heater 310 and high pressure-high temperature fluid enters expander intake port 317 for another cycle.

Pistons 303 are connected to and driven by shaft 304 which in turn derives power from the expander mechanism 319 via shafts 312 and gear box 311. The difference in power generated by expander 319 and that consumed by compressor 301 is transmitted by gear box 311 to output shaft 313.

Figure 4:
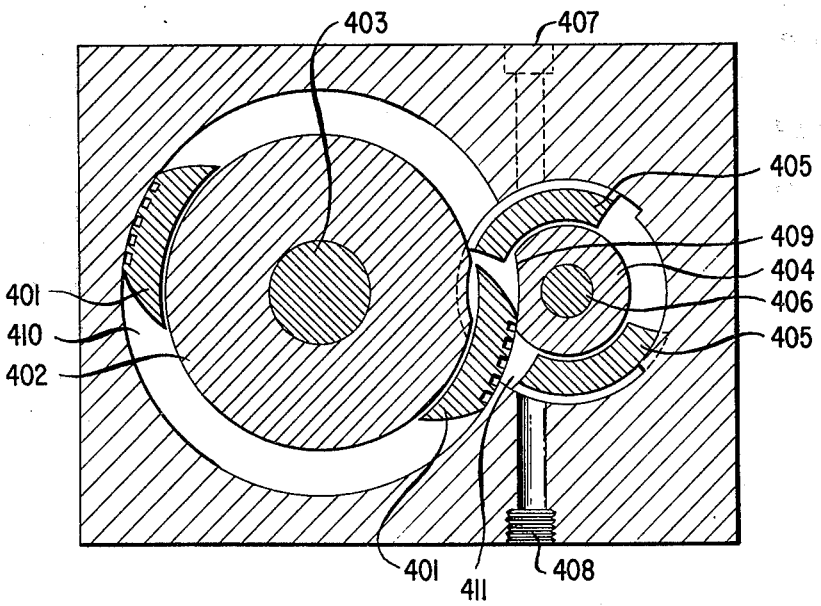
FIG. 4 is another embodiment of the mechanism in which both the main rotor and the sealing rotor are comprised of a stationary block with rotatable lobes.

FIG. 4 shows an additional embodiment of my invention in which the concept of substituting a stationary block with rotatable lobes for a one-piece rotor is applied to the sealing rotor as well as the main rotor. In FIG. 4, the main rotor consists of stationary block 402 and rotatable lobes 401. Lobes 401 are attached to shaft 403 by a circular disk (not shown). This assembly corresponds to stationary block 107, lobes 105, shaft 106 and disk 105A shown in FIG. 1. In FIG. 4, however, the sealing rotor (which in the previous embodiment was a single unit) now consists of stationary block 404 and movable lobes 405. Lobes 405 are connected to shaft 406 by means of a circular disk (which is not shown in the Figure), and the sealing rotor assembly has the same physical configuration as that of the main rotor shown in FIG. 4 and FIG. 1.

The embodiment shown in FIG. 4 has an advantage over the embodiment shown in FIG. 1 in that the contact between piston main rotor lobe 401 and the seal rotor lobe 405 is not as critical as in the previous embodiment. In the embodiment shown in FIG. 1, as the main rotor lobes engage the cavities 108A in the sealing rotor, virtual contact must be maintained between the edges of the sealing rotor lobe and the edges of the main rotor lobes in order to provide satisfactory sealing. In the embodiment shown in FIG. 4, however, a satisfactory seal may be maintained between main rotor lobes 401 and stationary block 404 by means of semi-cylindrical cutout 409 in block 404. This cutout has the effect of making the leakage path substantially longer, therefore, allowing the use of noncontacting labyrinth sealing arrangements. In addition, bearing loads caused by unequal working fluid pressures are transmitted mainly to stationary block 404 of the sealing rotor rather than to the bearings on shaft 406.

As with the previous embodiment, sealing rotor lobes 405 may have two longitudinal sections of unequal diameter which arrangement allows port 407 to be periodically valved off from working volume 410 while port 408 remains in constant communication with volume 411.

Although all of the embodiments shown have consisted of two pistons, it would be obvious to one skilled in the art to produce mechanisms with 3, 4, or any number of pistons. Also, more sealing rotors may be used to enable the mechanism to perform additional cycles of compression or expansion during each rotation. These modifications are apparent from an inspection of my illustrative embodiment and are within the spirit and scope of my invention.

What is claimed is:

1. In a rotary engine of the rotary-abutment type having a housing with a plurality of cylindrical intercommunicating parallel bores therein and a piston centrally located in one of said bores, said piston having at least one rotatable lobe, the improvement comprising:

a cylindrical rotary abutment centrally located in another of said bores substantially engaging said piston and having at least one recess therein to engage said lobe during rotation, said rotary abutment having a first and a second section located along the axis thereof, said first section maintaining close clearance with the wall of said other bore and said second section having a diameter substantially smaller than said first section; and means for defining discharge and intake ports in said housing for said rotary engine, said ports communicating with said other bore at different points along the axis thereof, one of said ports being located over said first section of said rotary abutment and the other of said ports being located over said second section of said rotary abutment so that said one of said ports located over said first section is sequentially opened and closed during the rotation of said abutment by said first section while said port located over said second section remains in constant communication with said other bore.

2. In a rotary engine, the improvement according to claim 1 wherein said rotary abutment has two recesses therein, each of said recesses having a part-cylindrical concave surface, and being located at diametrically opposite points on the periphery of said rotary abutment, said recesses dividing the periphery of said rotary abutment into two distinct part-cylindrical convex surfaces, said convex surfaces being diametrically opposed.

3. In a rotary engine, the improvement according to claim 2 wherein each of said part-cylindrical convex surfaces is divided into two, part-cylindrical areas; a first part-cylindrical area corresponding to said first section and a second part-cylindrical area corresponding to said second section, said first and said second areas being aligned axially, and wherein the distance between said first area and its axis of rotation is greater than the distance between said second area and its axis of rotation so that a step is formed ast its line where the two areas meet.

4. In a rotary engine, the improvement according to claim 3 further comprising a first arcuate, part-cylindrical extension attached to the section of the wall of said other bore lying between said discharge and said intake ports, said first extension having an axis parallel to the axis of said other bore and a length equal to the length of said second section, and maintaining close clearance with said second part-cylindrical area.

5. In a rotary engine according to claim 4 wherein said piston comprises a cylindrical stationary block centrally located in said one bore having a diameter smaller than the diameter of said one bore and a part-cylindrical recess on the periphery thereof, the improvement further comprising a second arcuate, part-cylindrical extension attached to said part-cylindrical recess having length equal to the length of said second section and maintaining close clearance with said second part-cylindrical area.

6. A rotary displacement mechanism for use in a rotary engine or compressor comprising a housing having a plurality of intercommunicating bores, at least one intake port and at least one discharge port therein;

a piston located in one of said bores, said piston having at least one rotatable lobe;

a sealing rotor having at least one recess therein to accept said lobe during rotation, said sealing rotor being located in another of said bores and further comprising a first and a second section located along the axis thereof, said first section maintaining close clearance with the wall of said other bore and said second section having a diameter substantially smaller than said first section, said discharge and said intake ports being located at different points along the axis of said other bore, one of said ports being located over said first section of said sealing rotor and the other of said ports being located over said second section of said sealing rotor.

7. A rotary displacement mechanism according to claim 6 wherein said piston comprises a stationary block centrally located in said one of said bores, the periphery of said block being located a constant distance from the wall of said one bore, and at least one curved-strip piston rotatable in the space between said block and the wall of said one of said bores, said piston maintaining virtual contact with said block and the wall of said one of said bores.

8. A rotary displacement mechanism according to claim 1 further comprising a first arcuate extension of said housing disposed on the periphery of said other bore between said intake and said discharge ports, said first extension having a length equal to the length of said second section and maintaining close clearance therewith.

9. A rotary displacement mechanism according to claim 8 further comprising a second arcuate extension radially extending from said piston, said second extension having a length equal to the length of said second section and being located along the axis of said piston so as to maintain close clearance with said second section.

10. A rotary displacement mechanism for use in a rotary engine or compressor comprising:

a housing having radial walls defining intersecting parallel cylindrical bores;

a male rotor located in one of said bores, said male rotor having a plurality of substantially cycloidal-shaped lobes about the circumference of said rotor;

a female rotor located in another of said bores, said female rotor having a plurality of cavities therein for receiving said lobes, said cavities being shaped to effect sealing with the sides of said lobes, said rotor having a first and second section located along the axis thereof, said first section maintaining close clearance with the wall of said other bore and said second section having a diameter substantially smaller than said first section; and means for synchronizing the rotation of said male and female rotors to cause said lobes to engage said cavities.

11. A rotary displacement mechanism according to claim 10 further comprising means for defining discharge and intake ports in said housing, said ports communicating with said other bore and located at different points along the axis thereof, one of said ports being located over said first section of said female rotor and the other of said ports being located over said second section of said female rotor.

12. A rotary displacement mechanism according to claim 11 wherein said intake port and said discharge port communicate with said other bore at points which are diametrically opposite.

13. A rotary displacement mechanism for use in rotary engine or compressor comprising a housing having radial walls defining intersecting parallel cylindrical bores;

a male rotor located in one of said bores, said male rotor having a plurality of substantially cycloidal-shaped male rotor lobes about the circumference of said rotor;

a female rotor located in another of said bores, said female rotor comprising a stationary cylindrical core and a plurality of bar-shaped female rotor lobes having axes parallel to the axis of said core and being rotatable thereabout to define a plurality of moveable cavities for receiving said male rotor lobes, each of said female rotor lobes further comprising a first and second section located along the axis thereof, said first section maintaining close clearance with the wall of said other bore and said second section having a diameter substantially smaller than said first section.

14. A rotary displacement mechanism according to claim 13 further comprising means for defining discharge and intake ports in said housing, said ports communicating with said other bore and being located at different points along the axis thereof, one of said ports being located over a first section of said female rotor abutments and the other of said ports being located over said second section of said female rotor abutments.

15. An external combustion engine comprising a compressor and an expander displacement mechanism, said compressor mechanism and said expander mechanism each comprising a housing having a plurality of cylindrical intercommunicating bores therein; said bores having parallel axes;

a piston centrally located in one of said bores; said piston having at least one rotatable lobe;

a cylindrical sealing rotor centrally located in another one of said bores having at least one recess therein to accept said lobe during rotation, said sealing rotor comprising a first and second section located along the axis of said sealing rotor, said first section maintaining close clearance with the wall of said other bore in which said sealing rotor is located and said second section having a diameter substantially smaller than said first section and said engine further comprising means defining a discharge and an intake port, said ports being located at different points along the axis of said other bore in which said sealing rotor is located, one of said ports being located over said first section of said sealing rotor and the other of said ports being located over said second section of said sealing rotor;

means for heating working fluid;

means for applying heated working fluid to said intake port of said expander displacement mechanism;

a cooler for cooling working fluid;

means for directing expanded working fluid from said discharge port of said expander displacement mechanism to said cooler;

means for directing cooled and expanded working fluid to the intake port of said compressor displacement mechanism;

means for directing cooled and compressed working fluid from the discharge port of said compressor displacement mechanism to said heater; and means for transmitting output power generated by said expander displacement mechanism to said compressor displacement mechanism to provide motive power therefor.

* * * * *